US006161619A

United States Patent [19]

Head

[11] Patent Number: 6,161,619

[45] Date of Patent: Dec. 19, 2000

[54] RISER SYSTEM FOR SUB-SEA WELLS AND METHOD OF OPERATION

[76] Inventor: Philip Head, 178 Brent Crescent, Park Royal London NW10 7XR, United Kingdom

[21] Appl. No.: 09/244,299

[22] Filed: Feb. 3, 1999

[30] Foreign Application Priority Data

Feb. 6, 1998 [GB] United Kingdom ..... 9802421

[51] Int. Cl.[7] ..... F21B 17/01

[52] U.S. Cl. ..... 166/355; 166/367; 405/224.2; 405/167; 405/168.3

[58] Field of Search ..... 166/355, 360, 166/367, 350, 351, 352; 405/166, 167, 168.1, 168.2, 168.3, 168.4, 224.2, 224.3

[56] References Cited

U.S. PATENT DOCUMENTS

| | | | |
|---|---|---|---|
| 3,653,635 | 4/1972 | Bates, Jr. et al. | 166/352 |
| 3,677,302 | 7/1972 | Morgan | 405/224.2 |
| 3,918,379 | 11/1975 | McNary . | |
| 3,999,617 | 12/1976 | Iifrey et al. | 166/350 |
| 4,098,333 | 7/1978 | Wells et al. | 166/352 |
| 4,647,255 | 3/1987 | Pow | 405/168.1 |
| 4,662,786 | 5/1987 | Cherbonnier . | |
| 4,730,677 | 3/1988 | Pearce et al. | 405/224.2 |
| 5,778,981 | 7/1998 | Head | 166/367 |
| 5,960,885 | 10/1999 | Edwards et al. | 166/367 |

*Primary Examiner*—Eileen D. Lillis
*Assistant Examiner*—Frederick L. Lagman
*Attorney, Agent, or Firm*—Herbert Dubno

[57] ABSTRACT

An intervention riser for an oil or gas well, which forms a connection between the well head and a floating surface vessel, is sufficiently flexible to accommodate the relative vertical movement between and the well head and a floating surface vessel, is attached to a compensating deck on the vessel which is free to move vertically relative to the vessel, and has winching means having a winch line attached to the riser such that the winching means may pull upon the riser. The compensating deck comprises a deck surface supported on at least one vertically arranged gantry support. The riser system comprises a lower riser section which extends substantially vertically and is essentially rigid, being maintained under tension, and a flexible upper riser section to accommodate movements in the surface vessel.

8 Claims, 9 Drawing Sheets

RISER SYSTEM FOR SUB-SEA WELLS AND METHOD OF OPERATION

FIELD OF THE INVENTION

This invention relates to a riser system for accessing and servicing sub-sea oil or gas wells. The riser system may be used for production or to access an existing well to carry out intervention operations. Such access is required, for example, to take further measurements of the reservoir by introducing logging devices, for servicing or installation of electric submersible pumps to enhance production rates, replacing down-hole safety valves, cleaning-out debris, zonal isolation re-perforating and for other reasons.

BACKGROUND OF THE INVENTION

Typically for a sub-sea production well, the original drilling platform will have been removed and the well head will have to be accessed by means of a suitable surface vessel. In order that the required operations can be carried out to the well, it is necessary that the movement of the vessel, which is floating on the surface of the sea, is compensated, to ensure positional consistency with respect to the well itself, which is fixed on the sea bed. This is conventionally provided by means of a heave compensation system on the vessel itself which is extremely cumbersome and expensive.

GB-A-2297337 is an example of a riser system which overcomes this problem and provides compensation for the heave and swell of the sea by a continuous coiled tubing riser which extends from the surface vessel to the well and which adopts a controlled 'S' profile which accommodates the movements of the surface vessel without these movements affecting the lower regions of the riser at the well head end. The disadvantage of this system is that the whole riser has to be made out of special grade materials in order to be sufficiently flexible, and this is expensive, in particular for wells which are located on a sea bed more than several hundred or several thousand feet below the sea level.

Other existing systems which involve fixed or semi-fixed platforms are expensive to install and maintain.

OBJECTS OF THE INVENTION

It is an object of the invention to provide a riser system which can be rapidly deployed to provide a conduit between the well head and a floating vessel.

It is also an object of the invention to provide a riser system which can be used to transfer physically long tools into a well, as well as to perform heavy pushing and pulling exercises.

SUMMARY OF THE INVENTION

According to the invention there is provided an offshore oil or gas well intervention riser system, comprising a riser which forms a tubular path connection between the well head and a floating surface vessel, the riser being sufficiently flexible to accommodate the relative vertical movement between the well head and the floating surface vessel, the riser being attached to a compensating deck on the vessel which is free to move vertically relative to the vessel, and a winching means having a winch line attached to the riser such that the winching means may pull upon the riser Preferably the compensating deck comprises a deck surface supported on at least one vertically arranged gantry support.

Preferably the riser system comprises a lower riser section which extends substantially vertically and is essentially rigid and is maintained under tension and an upper riser section which is flexible to accommodate movements in the surface vessel.

Preferably the upper riser section terminates at a point upon the vessel.

Preferably a portion of the upper riser between the point of termination on the vessel and point of attachment upon the compensating deck is wound upon a reel.

Preferably the winching means is also the means by which the lower section is maintained substantially vertically.

Preferably the compensating deck comprises a deck surface supported on at least one vertically arranged gantry support.

Preferably also the riser system comprises a lower riser section which extends substantially vertically and is essentially rigid and is maintained under tension and an upper riser section which is flexible to accommodate movements in the surface vessel.

Tension may be induced in the lower riser by a tensile tie to the vessel. The lower riser will preferably be a coiled tubing riser which is lowered down from a riser coiled tubing reel.

Though the compensating deck will be able to contribute to compensation for the rise and fall of the vessel due to the movement of the surface of the sea, it will not always be possible to rely on it alone. It is dangerous to allow the compensating deck to rise and fall when there are men working close to it. Also, the amount of movement available to the compensating deck is limited by the height through which the deck may travel relative to the vessel, and building a compensating deck for the largest waves will result in the compensating deck supporting structure being impractically high. Furthermore, to carry out an emergency disconnect procedure, in which after being disconnected from the well head, the riser must be lifted clear of the well head to avoid damaging it, the riser may be raised upwards further and more quickly by the winching means than by causing the compensating deck to be raised.

The upper flexible section of the riser extends for a depth which is sufficient to accommodate the expected heave on the surface vessel. The necessary length of upper flexible section will vary according to the sea or ocean conditions but is typically between 30 to 150 meters.

In a preferred embodiment of the invention a method and apparatus is provided which also provides positional consistency between the well head and the vessel without the need for an expensive heave compensation system on the vessel. The apparatus and method according to the invention also ensures that there is no damage caused to the well head by bending moments applied by movement of the piping connecting it to the surface vessel.

The lower section preferably has a control valve at its upper end which may be closed when it is required to access the inside of the riser at the surface vessel. Such access will be required to lower different tools and instruments into the well and the upper end of the riser needs to be opened for this purpose which exposes the well fluids to the surface vessel. Because this is potentially dangerous the well fluids are isolated by closing the control valve. The well fluids in the riser above the control valve can either be bled away after the valve has been closed, or alternatively pressed back down the riser by an inert fluid before the control valve is closed. Preferably the control valve is a double ball valve.

The position of the vessel may be adjusted so that a smooth continuous and sufficiently shallow curve is provided in the flexible upper section of the riser permitting equipment to be transmitted inside between the surface vessel and the well. Preferably though the vessel is arranged directly over the well and the riser is maintained vertical so that heavy pulling or pushing operations can be carried out in the well. This is also advantageous for the transmission of very long tools down the riser onto the well which would not be able to pass through curvatures in the riser.

Preferably the upper riser includes a plurality of discrete collars which are connected together and surround the outer diameter of the upper riser. The collars are connected together by connection means which permit a limited degree of relative axial movement which controls the radius of curvature of the upper riser section.

Preferably the curvature control means of the upper riser section has two states, a first state in which the upper riser section is permitted to bend sufficiently to be wound on a reel and a second state in which the upper riser section is permitted to bend only to a lesser extent.

Preferably activation means are provided on the vessel to convert the upper riser section from the first state to the second state as the riser is unreeled from a reel.

According to another aspect of the invention there is also provided a method of installation of the well riser system which comprises the following steps:

a. positioning a vessel approximately over a well head in which well intervention operations are required to be carried out, b. lowering a riser section towards the well head from a riser reel, c. connecting the riser to a support line at its upper end and lowering it further to the well head and connecting it thereto preferably with the assistance of a remote vehicle and guide lines, and d. inserting a well intervention tool in the riser from a well intervention reel arranged on a compensating deck on the vessel.

BRIEF DESCRIPTION OF THE DRAWING

There is now described a riser system embodying the invention, in which the system is shown being used for well intervention, with reference to the accompanying drawings, given as an example and not intended to be limiting which.

DESCRIPTION OF THE PREFERRED EMBODIMENT

Figure 1:
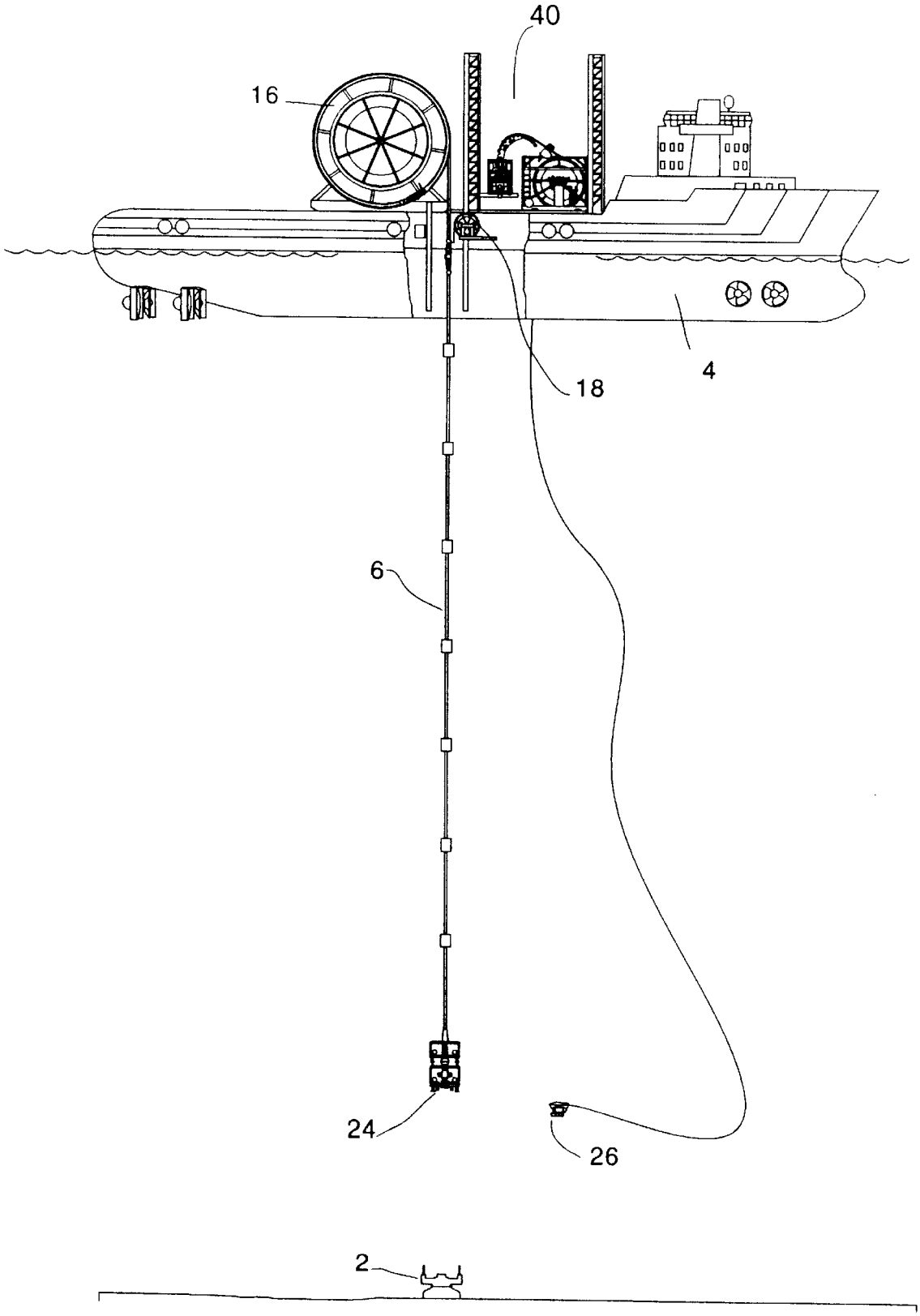
FIGS. 1 to 3 are elevations of the riser system, showing the first to fourth stage of the installation, and the system in use.
Figure 2:
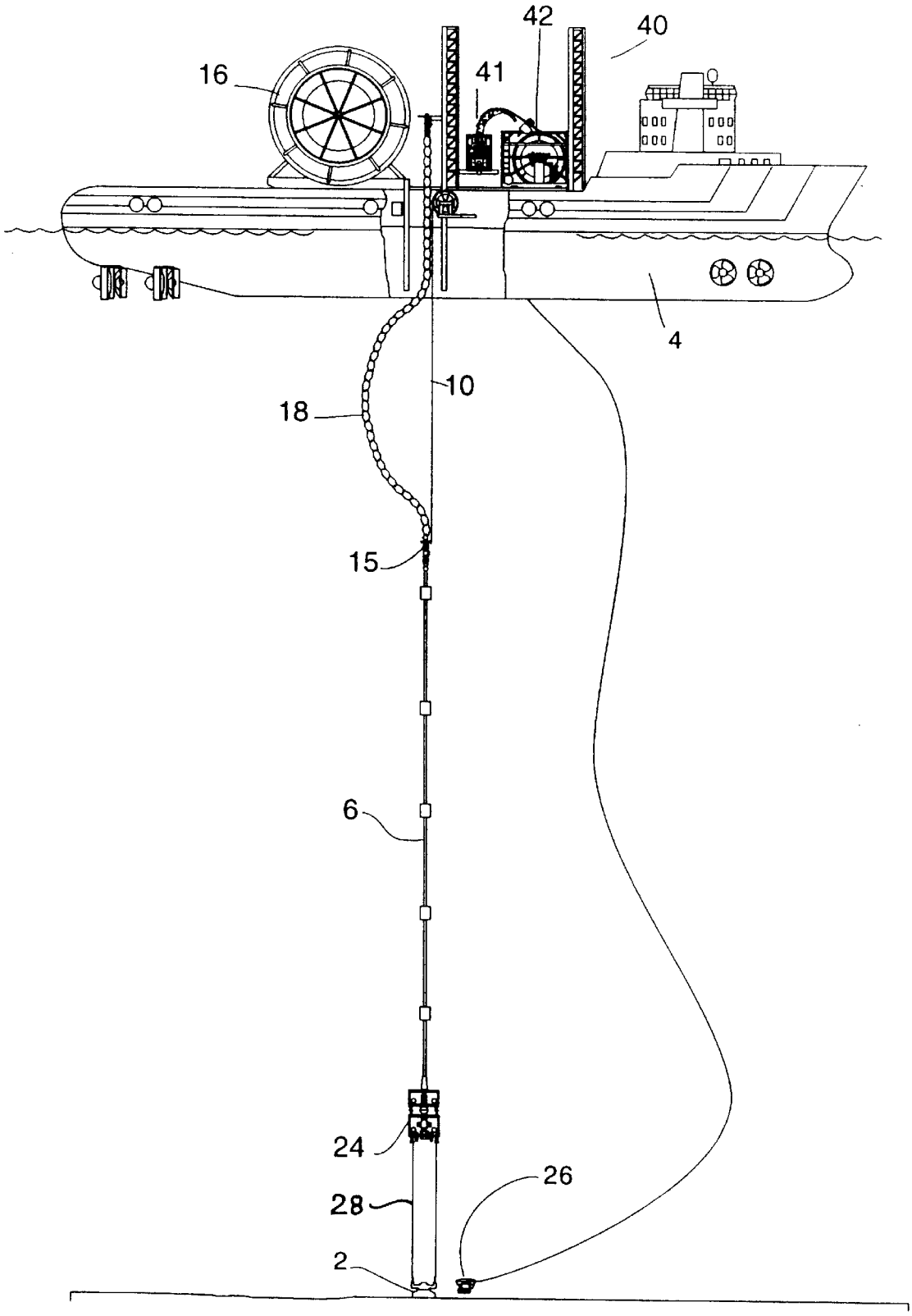
Figure 3:
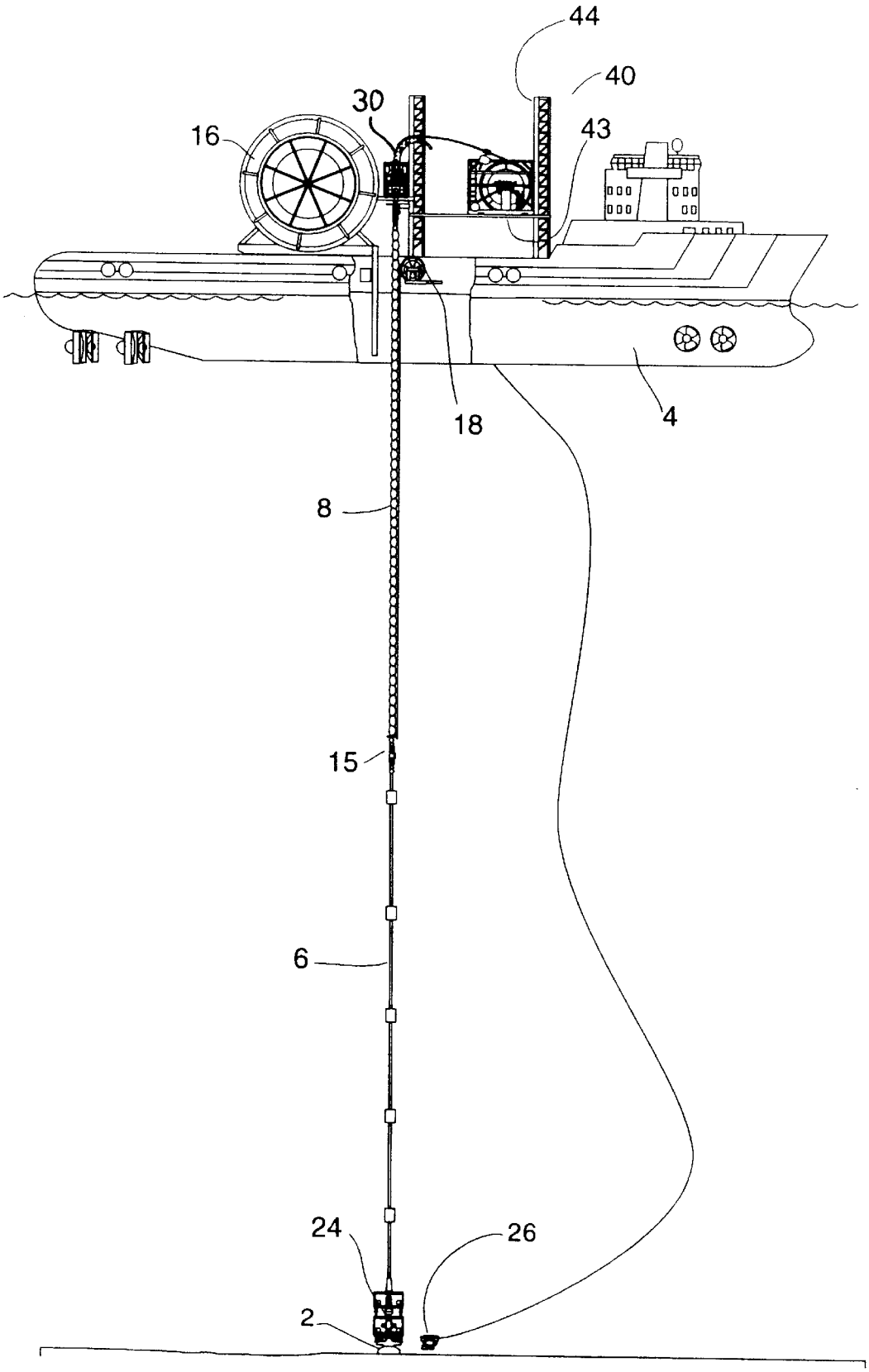

Referring to FIGS. 1 to 3 there is a shown an offshore oil and gas well riser system 1 which forms a connection between the well head 2 and a surface vessel 4. The riser system 1 comprises a lower riser section 6 which extends vertically and is essentially rigid and an upper riser section 8 which is made of a flexible material to accommodate movements in the surface vessel 4.

The main portion of the riser will be composed of coiled tubing, although it is also proposed to use a section of flexible armored material for the riser section near the surface which will be most subject to the most extreme effects of the weather.

The surface vessel is intended to be any conveniently available vessel having dynamic positioning, such as a diving support vessel.

A Remotely operated vehicle (ROV) 26 may be used to carry out the required sub-sea manipulation tasks.

Referring to FIGS. 1 to 3 in sequence, the method of installation of the well riser system 1 can be followed.

Firstly, the vessel is positioned in the desired location with respect to the well head in clear water.

The lower riser package 24 is positioned in the vessel ready for lowering, for example through a moon pool, and is connected to the free end of the lower riser section which at this stage is stowed on a spool 16. Referring to FIG. 1, the spool 16, upon which is wound the lower riser section 6, is slid into position on the vessel and the lower riser section is lowered into the water towards the well head 2.

The lower riser section 6 is completely unwound and the upper end of the lower riser section is released from the riser reel 16 and hung off at the exit of the vessel i.e. a moon pool. The tie line 10 is then connected to the top of the lower riser section 6 and is connected to winches on the vessel 4 at its upper end. The bottom end of the upper flexible riser 8 is then connected to the top of the lower riser 6, and the flexible riser 8 and the tie line 10 are unreeled from a reel and lowered towards the well head, as shown in FIG. 2. The weight of the entire payload is taken by the tie line 10 so that the flexible riser section 8 is not damaged.

The lower end of the lower riser section 6 and the lower riser package 24 is connected to the well head 2 preferably with the assistance of a remote vehicle 26 and guide lines 28 and corresponding guide posts on the well head 2. Referring to FIG. 3, using the pulling winches the lower riser package is latched onto the Christmas tree of the well head 2. The winches are then set to impart a constant tension to the tie lines 10 to give the desired tension in the lower riser section. The top part of the upper riser section may now be attached to the compensating deck 40.

The function and pressure test procedure is then carried out before proceeding with the well intervention operations.

In this embodiment the injector 30 is shown which may then be used to inject a further coiled tubing of narrower diameter than the internal diameter of the riser to carry out certain intervention operations.

The lower riser section 6 is conveyed on a riser reel 16 on the vessel 4 and when unreeled is connected at its upper end to a winching means 18 upon the vessel by a tie line 10 which is maintained in tension in order to support the weight of the lower section 6. Alternatively a buoyancy support means (not shown) may be used to support the lower riser section in tension. The buoyancy support means may be sufficiently evacuated to provide an upward force on the lower riser section 6 and to the well head 2. A lower riser package 24 is arranged at the lower end of the lower riser section 6. The lower riser package 24 comprises a tree blow out preventer (BOP) which is preferably a dual ram BOP which will be primarily used in the event of an emergency disconnect. The BOP will be capable of cutting the coiled tubing and retaining the pressure in the well thereby preventing any hydrocarbon release. A tree connector connects the Christmas tree of the existing well head 2 to the lower riser 6. The winching means 18 may also be used to lower riser package 24 to the Christmas tree at the tree connector. Upon reaching the Christmas tree, the riser package latches on to it.

The lower riser section 6 shown here is a coiled tubing riser which is lowered down from a coiled tubing reel. It constitutes the main section of the riser and is essentially an extension of the well tubing. It will be appreciated however that for the purposes of the invention the lower riser section could be provided by joined tubing. The tie line 10 is tension adjusted to hold the lower riser section 6 essentially vertically in tension with an acceptable offset dependent upon the environmental conditions and the length of the section 6.

A sub-sea valve assembly 15 may also be located at the top of the lower riser section. In this embodiment this is shown as a double block valve assembly 15 and is primarily required to isolate the flexible riser from the coiled tubing riser. This permits the deployment of tool strings into the flexible riser without the need to de-pressurize the coiled tubing riser 6. The valve assembly 15 also serves to seal the contents in the event of an emergency and will be able to shear through anything inside the riser in the event of an emergency.

Emergency disconnect means are provided to enable disconnection from the lower riser section 6 in the event of an emergency. The disconnect operation would be sequenced with well pressure control devices to ensure that the well is made safe before the disconnect activates. The riser is then lifted clear of the sea bed and the well head by operating the winching means 18 which pulls the riser up by tie lines 10.

The upper flexible section 8 of the riser system 1 extends between the top of the lower riser section and the vessel 4 for a depth which is sufficient to accommodate the expected heave on the surface vessel 4. The necessary length of upper flexible section will vary according to the sea or ocean conditions but is typically between 30 and 150 meters. This can be adjusted by the operation according to the prevailing conditions in the particular location in which the vessel is operating. Conveniently, this decision will be made before the vessel leaves shore and the required length of flexible tubing for the upper section and rigid tubing for the lower section calculated according to the expected conditions at the location of the well can be stowed on the vessel.

The upper end of the upper riser section is required to be fixed to a compensating deck 40 on the vessel. During this operation it is necessary that the top of the upper riser section 8 rises and falls with the surface of the sea so that there is no relative movement between the top of the upper part of the riser and the vessel in order that the upper riser can be secured to the vessel.

The compensating deck is free to move vertically to compensate the relative movement between the riser when it is fixed to the sea bed and the vessel which floats in the water and moves up and down with the water. The compensating deck 40 shown in this embodiment comprises a deck surface 43 which is permitted to move vertically by sliding supports on two vertically arranged support gantries 44. The weight of the deck and the equipment on it is taken up by a hydraulic support system (not shown) so that the deck 40 remains essentially fixed with respect the riser 8.

The position of the surface vessel 4 is preferably maintained essentially vertically above the well head. Once the upper end of the upper riser section 8 has been secured to the compensating deck 40, the well intervention tubing 41 can be deployed from the well intervention tube reel 42. The flexible riser section 8 can thus now be maintained vertically because it is no longer necessary for the riser to be compensate for the vessel's movement, as shown in FIG. 3. It is therefore possible to carrying out operations requiring heavy pushing or pulling which need a vertical riser to the well.

Thus it can be seen that by means of the present system a wide variety of operations can be performed and the flexibility of the system provides considerable cost savings over existing systems.

Referring to FIGS. 4 to 7, the curvature of the upper riser section 8 is controlled by curvature limiting means which in the embodiment shown is a plurality of discrete collars **8*a* which are connected together and surround the outer diameter of the upper riser 8. The collars 8*a* are connected together by connection means 8*b* which permit a limited degree of relative axial movement between adjacent collars which has the effect of controlling the radius of curvature of the upper riser section 8**. The curvature of the upper riser section will be limited to the elastic limit of the material of the section riser section and preferably well within the elastic limit to provide an extended, fatigue free life.

The curvature control means of the upper riser section has two states, a first state in which the upper riser section is permitted to bend sufficiently to be wound on a reel, and a second state in which the upper riser section is permitted to bend only to a lesser extent during deployment as a riser.

Figure 4:
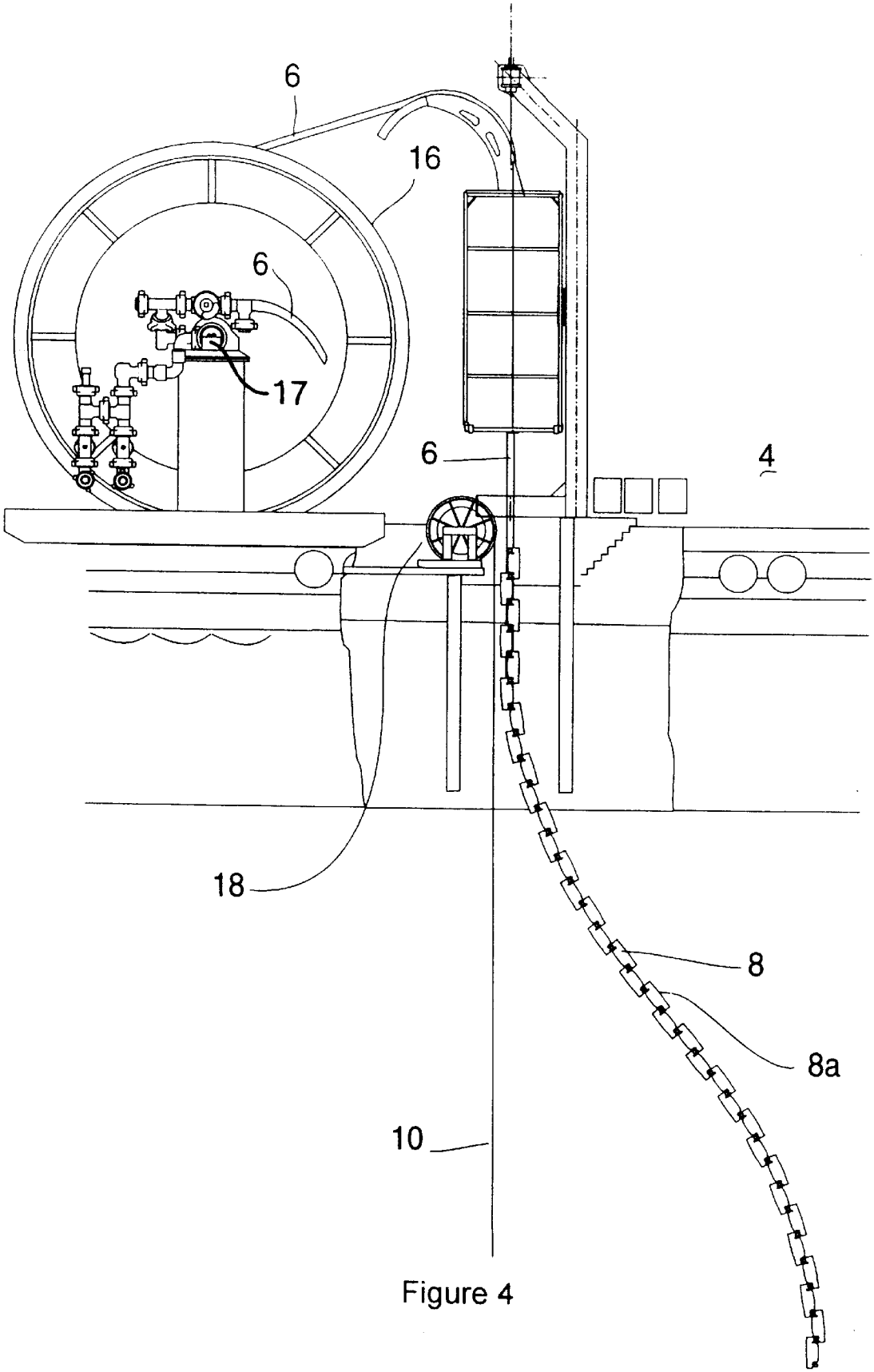
FIG. 4 is an elevation of the riser system showing an enlarged view of the upper riser in the region of the vessel.
Figure 5:
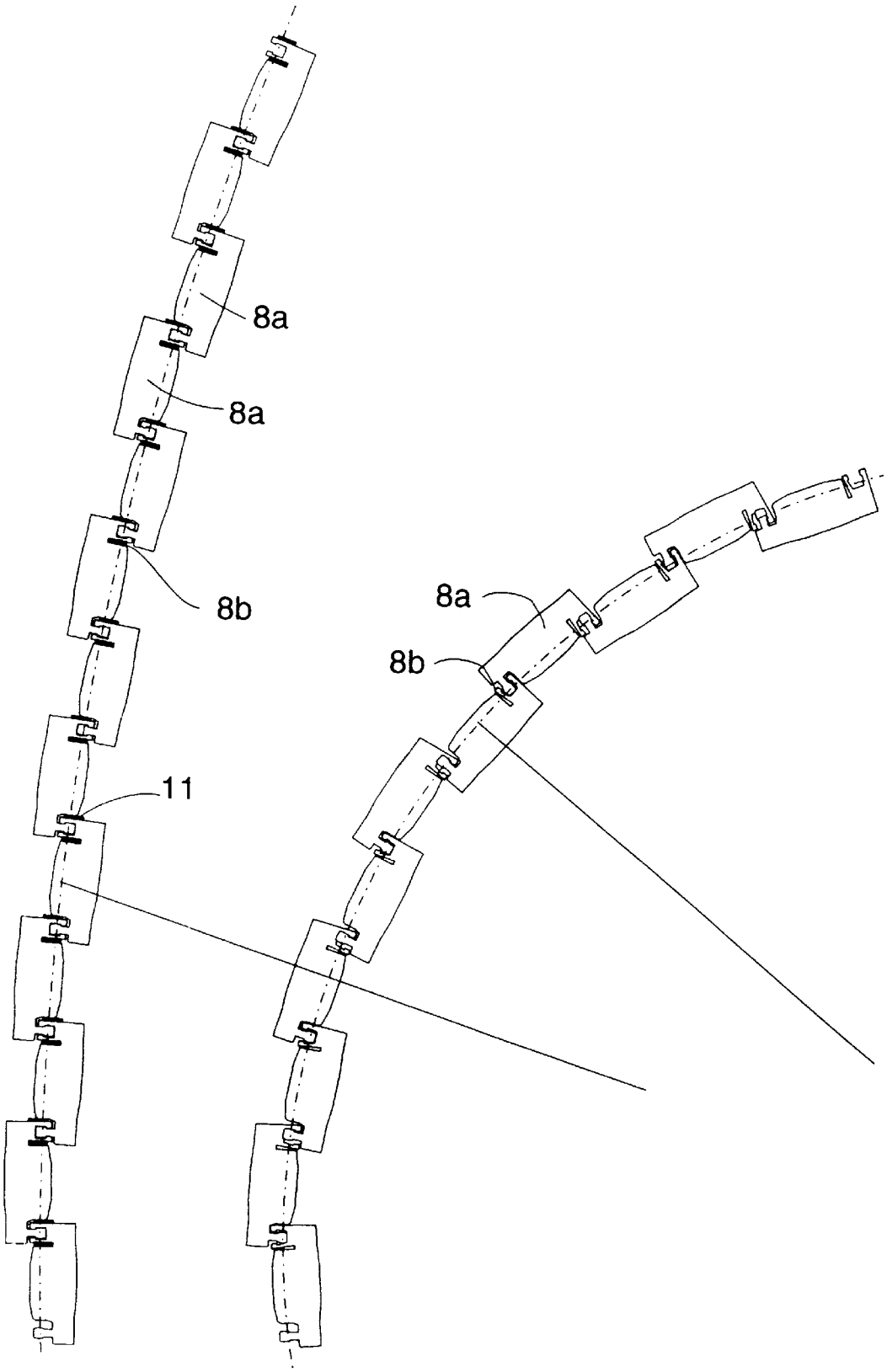
FIG. 5 is an elevation of the riser system showing a further enlarged view of an embodiment of the curvature limitation means.

As shown in FIG. 4, the riser can be connected to valves upon the drum axle 17 so that the riser does not have to be fully deployed from the storage reel 16 for part of the upper riser to be attached to the compensating deck and intervention operations, such as flow testing and the like, performed. Alternatively, the upper riser could be fully deployed from the reel and attached to the compensating deck by its upper end, and thence be connected so as to perform intervention operations.

Thus activation means are provided on the vessel to convert the upper riser section from the first state to the second state as the riser is unreeled from a reel. An exemplary embodiment of such an activation means is shown in FIGS. 4 to 7. It can be seen from FIG. 5 how the radius of curvature of the upper riser is limited once it exits the reel 16. Each collar has a corresponding tongue and groove connection means **8*b* which links it to the adjacent collar. Alongside each groove each collar has a slot 9. In the unlimited state for reeling the riser onto the reel, the groove is left open and the connection means 8*b* permit greater axial movement of the respective collars by compression of the slot 9. In the curvature limited state for deployment the slot 9 is locked open by locking means 11** which prevent any compression of the groove and thus prevent any additional axial movement of the respective collars.

Figure 6:
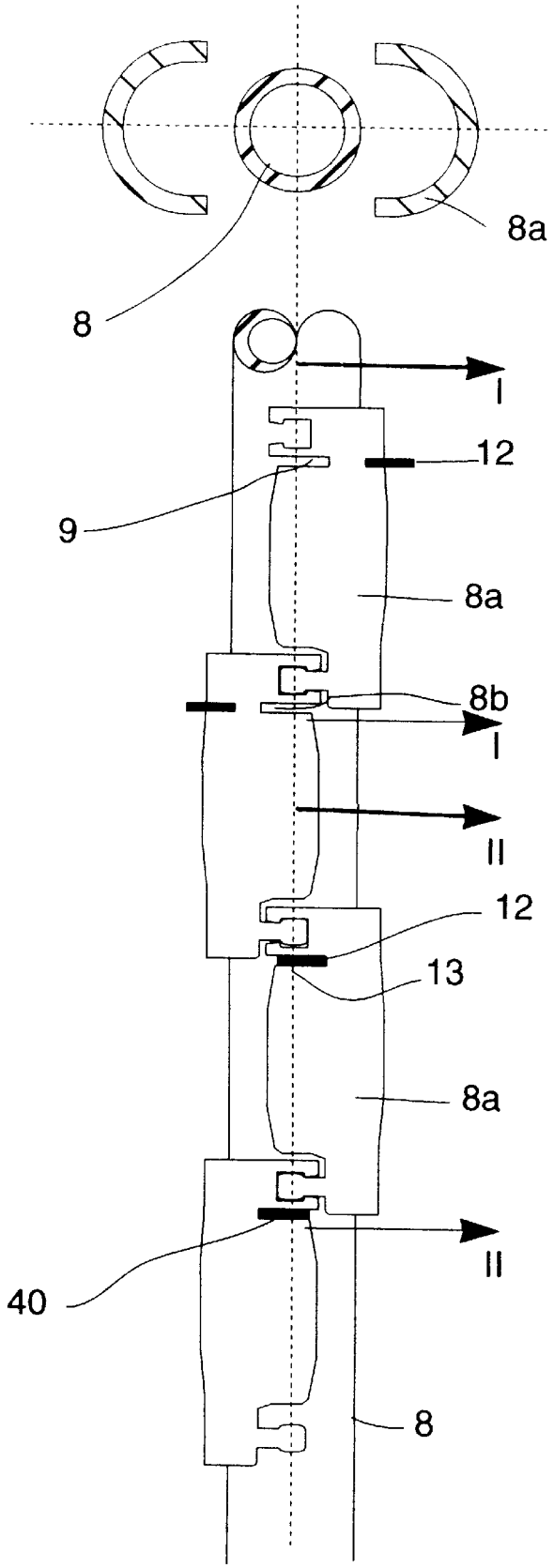
FIG. 6 is a further enlarged view of an embodiment of the curvature limitation means.
Figure 7:
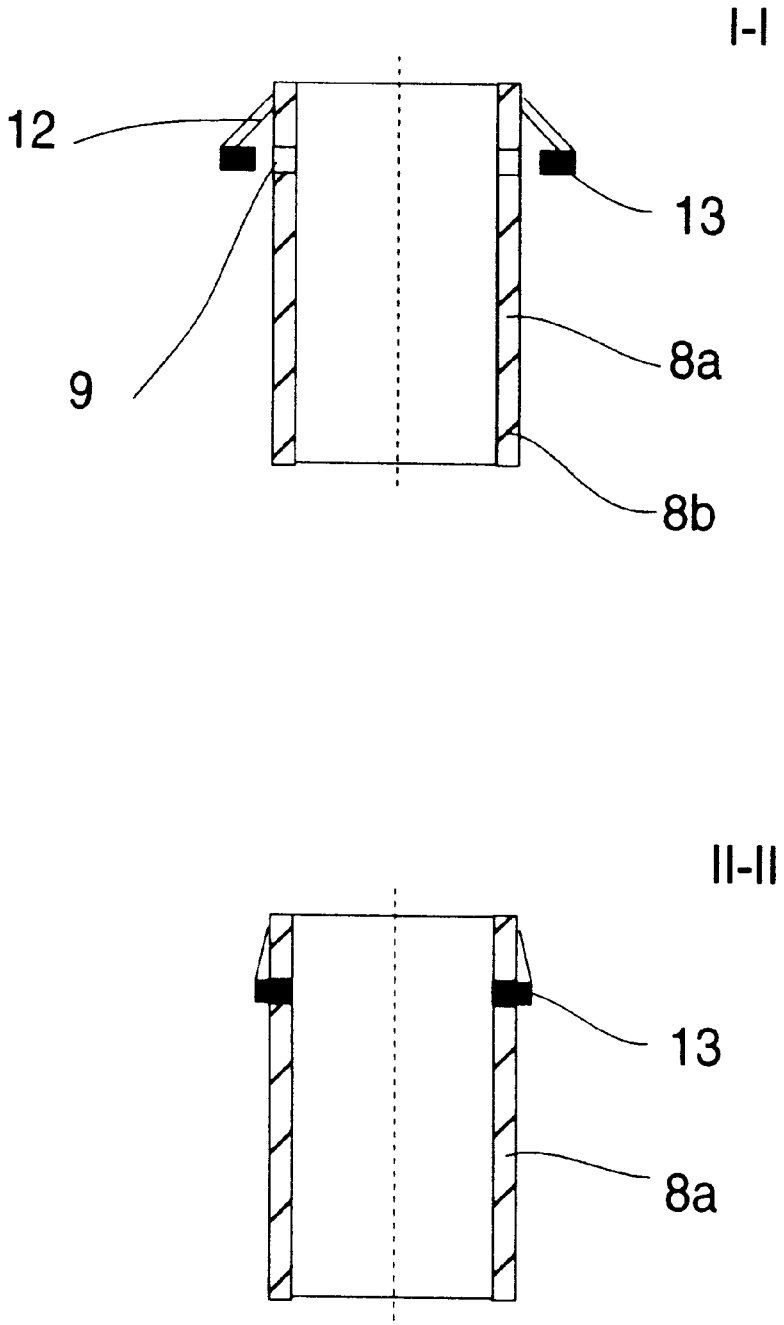
FIG. 7 is an enlarged view of an activation means for the curvature limitation means.

The locking means 11 can be engaged or activated by any suitable means and in this embodiment, as shown in FIGS. 6 and 7, they are in the form of a horseshoe shaped clip 12 comprising two arms 13 surrounding the collars **8*a*. The clip 12 has an outward position, as shown in the upper collar 8*a* in FIGS. 6 and 7, in which it is retained by detents (not shown), the two arms 13 of the horseshoe clip 12 are located outside the slots 9 of each collar 8*a* and the riser is free to bend on to the reel. The also has an inward position, as shown in the lower collar 8*a* in FIGS. 6 and 7, in which the two arms 13 of the clip 12 are engaged in the slots 9** and the more severe bending of the riser is no longer possible.

Figure 8:
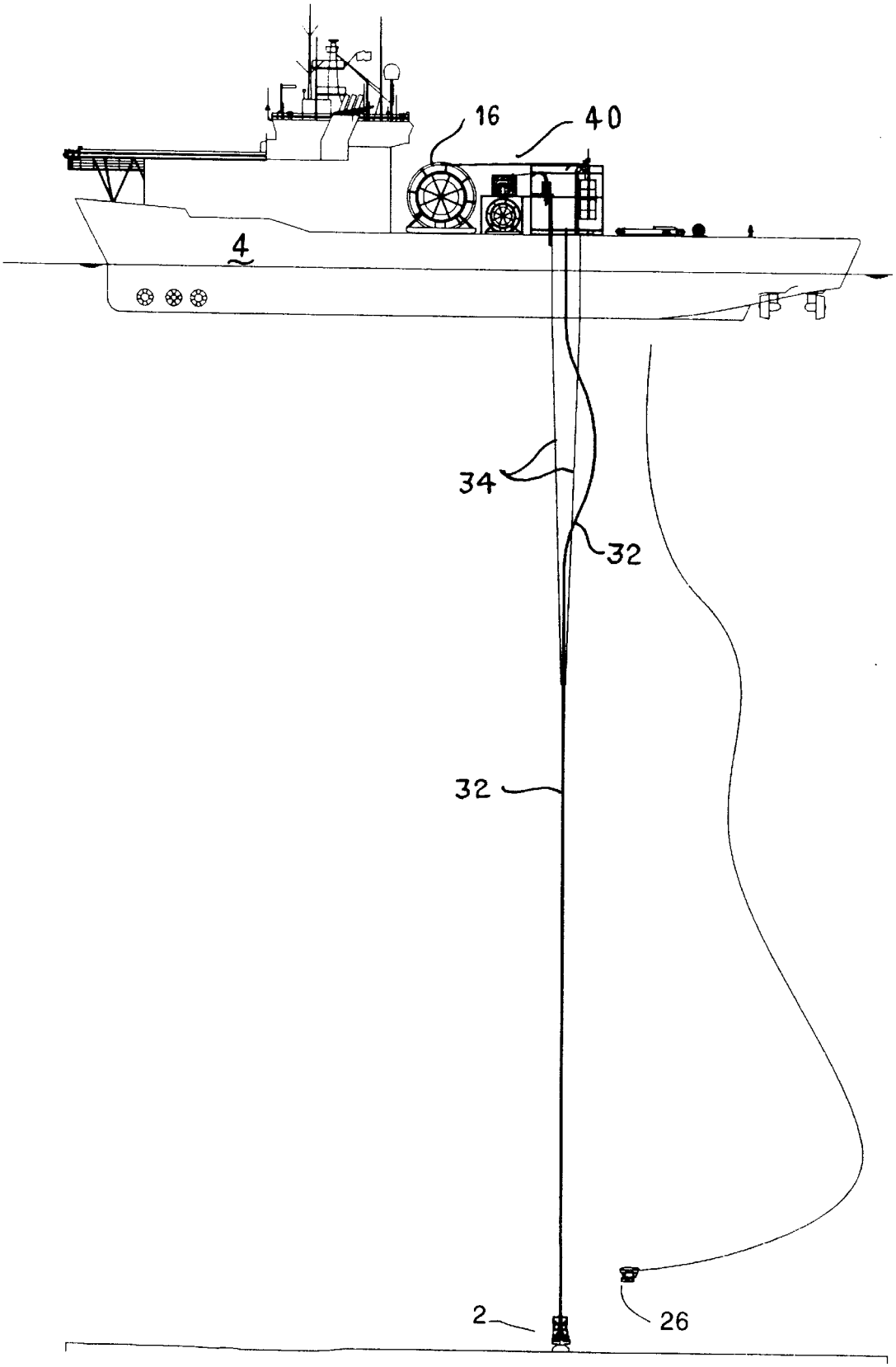
FIG. 8 is an elevation of an alternative embodiment of the riser system.

A further embodiment is shown in FIGS. 8 and 9. Referring to FIG. 8, the riser consists solely of a flexible section 32 making a connection between the well head 2 and a floating vessel 4, there being no separate lower rigid section of riser. The riser is unwound from the reel, and the lower riser package 24 is positioned above the Christmas tree as described for the previous embodiments, and attached, with the assistance of a remote vehicle for example. The rise and fall of the boat may then be taken up by the slackening of the riser 32, the riser being supported by two cables 34 which are held at a constant tension by some suitable means on the vessel.

Figure 9A:
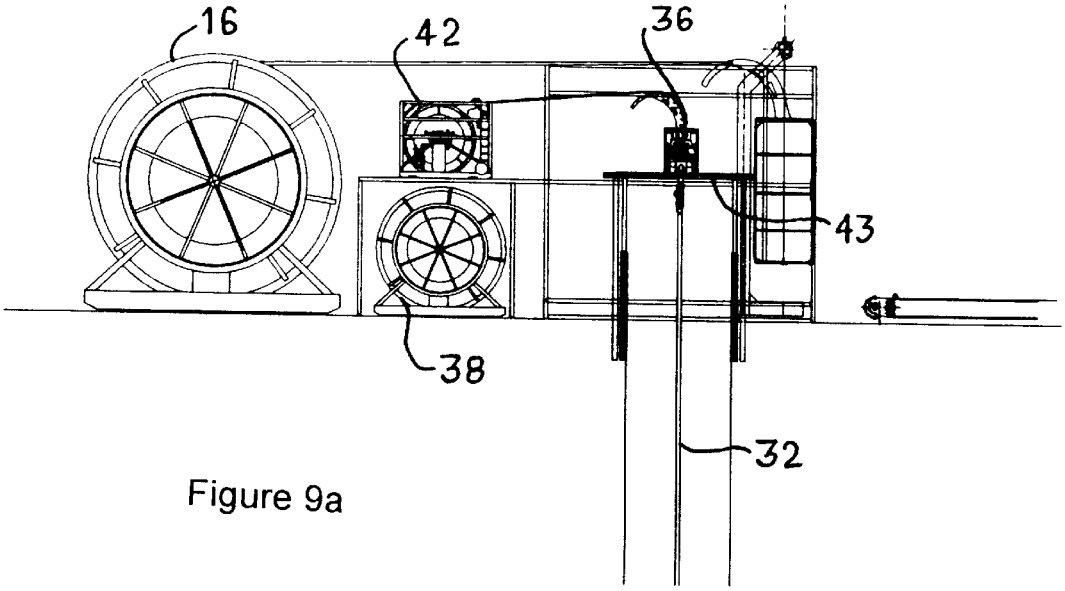
FIGS. 9*a* and 9*b* are enlarged views of the alternative embodiment in use.
Figure 9B:
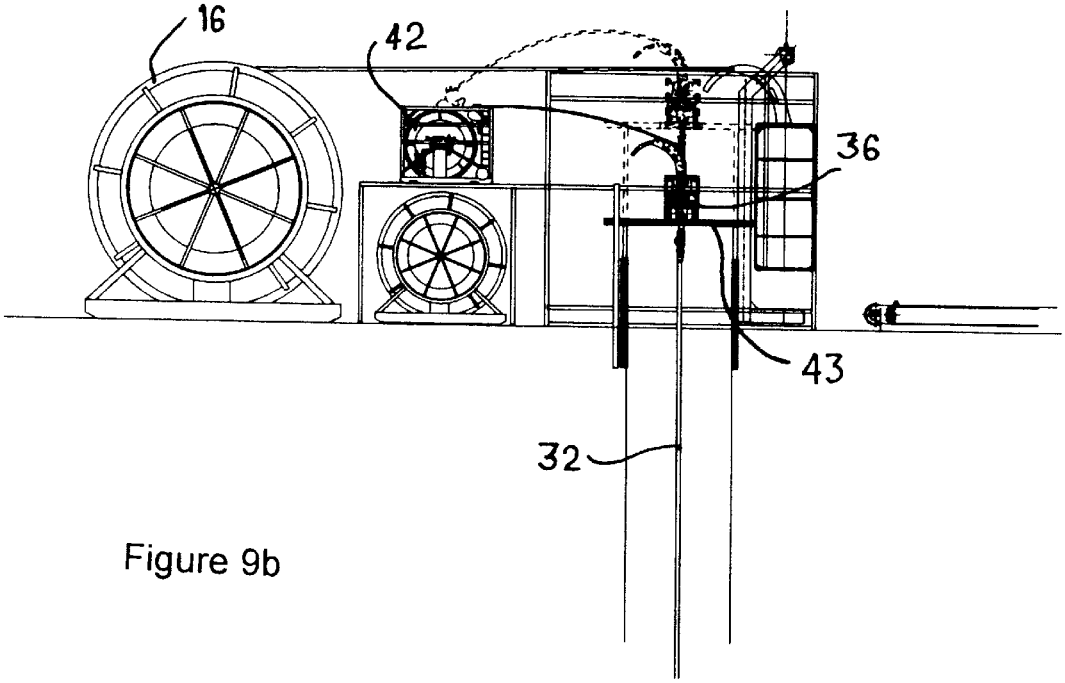

The rise and fall may also be taken up by the compensating deck 40, as shown in FIGS. 9*a* and 9*b*. The well intervention tube reel 42 in this embodiment is located upon the vessel rather than on the compensating deck 40, the tube being able to flex to accommodate the movement of the compensating deck. A well intervention injector 36 is attached above the riser 32 on the compensating deck platform 43 to introduce the necessary intervention tubing. In this embodiment there is also included a reel of umbilical tubing 38, the umbilical tubing being wrapped around the riser to transmit electrical or hydraulic signalling and the like, which may be winched up separately to the riser itself.

It will be appreciated that the present riser could be used as an intervention riser to carry out intervention operations in the well by introducing tools and instruments down the centre of the riser preferably by means of a narrowing diameter coiled tubing arranged within the riser but also by means of conventional coiled tubing. It will also be appreciated that the riser system of the present invention can be used as a production riser, as well as for drilling operations, and for flow testing of the well head. Alternative embodiments using the principles disclosed will suggest themselves to those skilled in the art, and it is intended that such alternatives are included within the scope of the invention, the scope of the invention being limited only by the claims.

What is claimed is:

1. An offshore oil or gas well intervention riser system comprising:

a floating surface vessel adapted to be positioned above a well head;

a riser extending downwardly from said vessel to said well head;

a reel on said vessel for accommodating at least an upper portion of said riser;

means including a multiplicity of interconnected segments along at least said upper portion of said riser for enabling at least said upper portion of said riser to bend, said segments being formed with means defining two bending states for said upper portion including a first state in which said upper portion can bend sufficiently to enable winding of said reel and a second state in which said upper portion has a curvature limited to a lesser extent that the curvature of said upper portion in said first state;

a compensating deck on said vessel movable vertically thereon to compensate for sea changes and to which said upper portion of said riser is connectable; and a winch on said vessel connected by a winch line to said riser for exerting an upward tension on said riser.

2. The system defined in claim 1 wherein said vessel is provided with a vertical gantry, said compensating deck being mounted for vertical movement on said gantry.

3. The system defined in claim 1 wherein said riser has a lower portion which is rigid at least under tension.

4. The system defined in claim 1 wherein said winch is constructed and arranged to maintain at least a lower portion of said riser vertical.

5. The system defined in claim 1 wherein said segments are collars connected together.

6. The system defined in claim 1 wherein said collars have articulations at opposite ends and slots adjacent said articulations enabling deformation of said collars, said slots receiving respective clips for limiting bending of said collars.

7. The system defined in claim 1 wherein said upper portion is activated from said first state to said second state as said riser is unreeled from said reel.

8. The system defined in claim 1 wherein said upper portion is de-activated from said first state to said second state as said riser is unreeled from said reel.

* * * * *